US005713732A

United States Patent [19]

Riney

[11] Patent Number: 5,713,732

[45] Date of Patent: Feb. 3, 1998

[54] ROTARY COMPRESSOR

[76] Inventor: Ross W. Riney, #2 Mandarin Cove, Lucas, Tex. 75002

[21] Appl. No.: 414,291

[22] Filed: Mar. 31, 1995

[51] Int. Cl.[6] ..... F04C 18/356; F04C 23/00

[52] U.S. Cl. ..... 418/212; 418/247

[58] Field of Search ..... 418/178, 212, 418/213, 245, 247, 248

[56] References Cited

U.S. PATENT DOCUMENTS

| | | | |
|---|---|---|---|
| 154,298 | 8/1874 | Teal | 418/247 |
| 445,318 | 1/1891 | Leach | 418/245 |
| 560,054 | 5/1896 | Williams | 418/247 |
| 669,360 | 3/1901 | Bates | 418/248 |
| 975,637 | 11/1910 | Renik | 418/248 |
| 1,015,663 | 1/1912 | Bonsteel | 123/222 |
| 1,334,906 | 3/1920 | Keith | 418/248 |
| 2,124,542 | 7/1938 | Chisholm | 123/16 |
| 2,373,669 | 4/1945 | Sturrock | 418/213 |
| 2,515,288 | 7/1950 | Barrett | 418/248 |
| 3,215,129 | 11/1965 | Johnson | 123/16 |
| 3,791,352 | 2/1974 | Takacs | 123/8.25 |
| 3,849,036 | 11/1974 | Read | 418/62 |
| 3,902,465 | 9/1975 | Stookey | 123/8.17 |
| 4,115,045 | 9/1978 | Wyman | 418/248 |
| 4,396,365 | 8/1983 | Hayashi | 418/179 |
| 4,415,321 | 11/1983 | Okazaki | 418/179 |
| 4,515,123 | 5/1985 | Taylor | 123/222 |
| 4,739,615 | 4/1988 | Staheli | 670/39.6 |
| 4,815,953 | 3/1989 | Iio | 418/179 |
| 4,848,295 | 7/1989 | Loran et al. | 123/222 |
| 4,859,164 | 8/1989 | Shimomura | 418/179 |
| 5,044,908 | 9/1991 | Kawade | 418/179 |
| 5,049,052 | 9/1991 | Aihara | 418/179 |
| 5,055,016 | 10/1991 | Kawade | 418/179 |
| 5,104,297 | 4/1992 | Sekiguchi et al. | 417/410 |
| 5,135,368 | 8/1992 | Amin et al. | 418/6 |
| 5,160,252 | 11/1992 | Edwards | 418/1 |
| 5,205,723 | 4/1993 | Kawai et al. | 417/415 |
| 5,230,616 | 7/1993 | Serizawn et al. | 418/151 |

FOREIGN PATENT DOCUMENTS

| | | | |
|---|---|---|---|
| 726275 | 10/1942 | Germany . | |
| 817058 | 10/1951 | Germany . | |
| 822312 | 11/1951 | Germany . | |
| 295541 | 4/1932 | Italy | 418/245 |
| 61-241484 | 10/1986 | Japan | 418/178 |
| 3100391 | 4/1991 | Japan | 418/178 |
| 6159259 | 6/1994 | Japan | 418/178 |
| 796601 | 6/1958 | United Kingdom . | |
| 1531541 | 11/1978 | United Kingdom . | |

OTHER PUBLICATIONS

Brochure, ROC Carbon Company, "High-Performance Carbon/Graphite Seals and Bearings for Rotating Equipment" Aug. 1993 (4 pgs.).

Brochure, ROC Carbon Company "ROCBON PTFE Composites 1000 Series Techinical Data" no date (2 pgs).

Brochure, ROC Carbon Company, "ROCBON Carbon Graphite Bushings/Bearings" no date (2 pgs.).

*Primary Examiner*—John J. Vrablik

*Attorney, Agent, or Firm*—Baker & Botts, L.L.P.

[57] ABSTRACT

A rotary compressor is provided, including: a housing containing a rotor having a compression eccentric and an axial shaft; a removable combination intake and exhaust manifold for conveying fluid into and out of a compression space formed between the compressor housing, the compression eccentric, and a removable combination dynamic seal and fluid channeling assembly which is securable between the manifold and the housing. The combination dynamic seal and fluid channeling assembly retains a dynamic seal in continuous contact with the compression eccentric and directs fluid into and out of the compression space. After being introduced through an intake port of the manifold, fluid is transferred past the combination dynamic seal and fluid channeling assembly, through a seal-engaging channel in the housing and into the compression space, where it is compressed via rotation of the compression eccentric about the axial shaft. Compressed fluid exits the compression space back through the seal-engaging channel and is directed toward an exhaust port of the manifold via the combination dynamic seal and fluid channeling assembly.

(List continued on next page.)

14 Claims, 6 Drawing Sheets

U.S. PATENT DOCUMENTS 5,236,318 8/1993 Richardson, Jr. ..... 418/1
5,240,386 8/1993 Amin et al. ..... 417/243
5,242,287 9/1993 Fujiwawa ..... 418/220
5,244,366 9/1993 Delmotte ..... 418/248
5,247,916 9/1993 Riney ..... 123/222
5,259,740 11/1993 Youn ..... 418/58
5,322,420 6/1994 Yannascoli ..... 417/366
5,322,424 6/1994 Fujio ..... 418/11
5,326,233 7/1994 Mochizuki et al. ..... 417/350

ROTARY COMPRESSOR

RELATED DISCLOSURE

This is related to U.S. Pat. No. 5,247,916 issued on Sep. 28, 1993 and entitled Rotary Engine.

BACKGROUND OF THE INVENTION

The present invention relates to fluid compressors, and more particularly concerns a rotary compressor. Please note that the term "fluid" as used herein refers to elements which may be in a liquid, a gaseous or a mixed liquid and gaseous state.

Many rotary compressor devices have been proposed in the prior art. Examples of such devices can be found in the following U.S. Pat. Nos.: 3,849,036, by Balfour; 4,396,365, by Hayashi; 4,415,321, by Okazaki; 4,815,953, by Iio; 4,859,164, by Shimomura; 5,044,908, by Kawade; 5,049,052, by Aihara; 5,055,016, by Kawade; 5,104,297, by Sekiguchi et al.; 5,135,368, by Amin et al.; 5,160,252, by Edwards; 5,205,723, by Kawai et al.; 5,230,616, by Serizawa et al.; 5,236,318, by Richardson, Jr.; 5,240,386, by Amin et al.; 5,242,287, by Fujiwawa; 5,259,740, by Youn; 5,322,420, by Yannascoli; 5,322,424, by Katuhara; and 5,326,233, by Mochizuki et al. While these devices may be suitable for a particular purpose to which they address, it will be apparent to those skilled in the art that said devices would not be as suitable for the purposes of the present invention.

Many advantages of rotary compressors made in accordance with the present invention may be derived from the unique simplicity of design inherent in the invention, which design provides a significant reduction in the costs associated with manufacturing and maintenance when compared to rotary compressors of the prior art. Said simplicity is due to the unique use of a combination dynamic seal and fluid channeling assembly. Use of such assembly allows for the combining of a rotor housing intake port, a rotor housing exhaust port and a compression seal engaging channel into a single conduit. Such combining results in a significant reduction in tooling costs during manufacture, and in subsequent maintenance costs during use of such rotary compressors, when compared to rotary compressor devices of the prior art. Additional maintenance cost reductions may be derived from the use of a removable manifold for securing the combination dynamic seal and fluid channeling assembly in place. By simply removing the manifold, one of the two high-velocity moving parts of the rotary compressor of the instant invention may be visually inspected. In one embodiment of the present invention, the combination dynamic seal and fluid channeling assembly may even be hand-removed and replaced immediately after removal of the manifold. Other embodiments of the present invention also include unique means for retaining the dynamic seal of said assembly in continuous contact with the compression eccentric of the rotary compressor, which means are likewise easily maintainable, and further which are able to retain the dynamic seal in such continuous contact with the compression eccentric that the compressor is able to achieve better compression efficiencies than have been previously known with rotary compressors. Still other embodiments of the present invention include the use of thermally resistant solid coatings on various compressor surfaces, for providing less thermal distortion of such surfaces and the ability to operate such embodiments with less liquid lubricant than required in rotary compressor devices of the prior art. Although some of the rotary compressor devices of the prior art have attempted to address the problems of manufacturability, maintainability and compression efficiency which have been associated with rotary compressor type devices, none has achieved the level of success in dealing with such problems as has the rotary compressor of the instant invention.

SUMMARY OF THE INVENTION

In view of the foregoing disadvantages inherent in the known types of rotary compressor devices now present in the art, the invention disclosed herein provides an improved rotary compressor which includes a housing containing a rotor having a compression eccentric and an axial shaft, a removable combination intake and exhaust manifold for conveying fluid into and out of a compression space formed between the compressor housing, the compression eccentric, and a removable combination dynamic seal and fluid channeling assembly, which assembly is securable between the manifold and the housing. Upon a closer review of the more detailed description herein, those skilled in the art will recognize that the concepts of the present invention easily overcome the problems described above which have been heretofore commonly associated with rotary compressor devices. As such, the general purpose of the present invention is to provide a new and improved rotary compressor which has all the advantages of the prior art and none of the disadvantages.

An even further object of the present invention is to provide a new and improved rotary compressor which is susceptible of a low cost of manufacture with regard to both materials and labor, and which accordingly is then susceptible of low prices of sale to the consuming public, thereby making such a rotary compressor economically available to the buying public.

It is an additional object of the present invention to provide a new and improved rotary compressor which may be easily and efficiently installed and maintained.

It is still a further object of the present invention to provide a new and improved rotary compressor which is of durable and reliable construction.

It is still a further object of the present invention to provide a new and improved rotary compressor which includes a thermally resistant solid coating on many of its moving surfaces which are in frictionable contact with at least another surface, for reducing the friction between such surfaces and, thereby, reducing the wear and tear of such surfaces.

It is yet still a further object of the present invention to provide a new and improved rotary compressor which meets all federal, state, local and other private standards, guidelines, regulations and recommendations with respect to safety, environmental friendliness, energy conservation, etc.

These together with other objects of the invention, along with the various features of novelty which characterize the rotary compressor of the present invention, are pointed out with particularity in the claims appended hereto and forming part of this disclosure. The more important objects of the present invention have been outlined rather broadly in order that the detailed description thereof which follows may be better understood, and in order that the present contribution to the art may be better appreciated. For a better understanding of the instant invention, its operational advantages and the specific objects attained by its uses, reference should be made to the accompanying drawings and descriptive matter in which there are illustrated various embodiments of the invention.

Those versed in the art will readily ascertain, however, that the present invention is capable of other embodiments and of being practiced and carried out in various other ways. In this respect, the details of construction disclosed herein, including the component materials and the arrangements of the components set forth in the following description and appended drawings, are for illustrative purposes, only, and are not intended to be limiting in scope. Those skilled in the art will appreciate, as well, that the conception upon which this disclosure is founded, may be readily utilized as a basis for the designing of other structures, methods, and systems for carrying out the several purposes of the present invention. Said other structures may include, but are not limited to, those which are aesthetic in nature, or those which include the substitution of other materials as they become available, and which substantially perform the same function in substantially the same manner with substantially the same result as the present invention. It is important, therefore, that the claims appended hereto be regarded as including such equivalent materials, structures, constructions, methods, and systems insofar as these do not depart from the spirit and scope of the present invention.

BRIEF DESCRIPTION OF THE DRAWINGS

The invention will be better understood and objects other than those set forth above will become apparent when consideration is given to the following detailed description. Such description makes reference to the appended drawings, wherein.

DETAILED DESCRIPTION OF VARIOUS EMBODIMENTS

Figure 2:
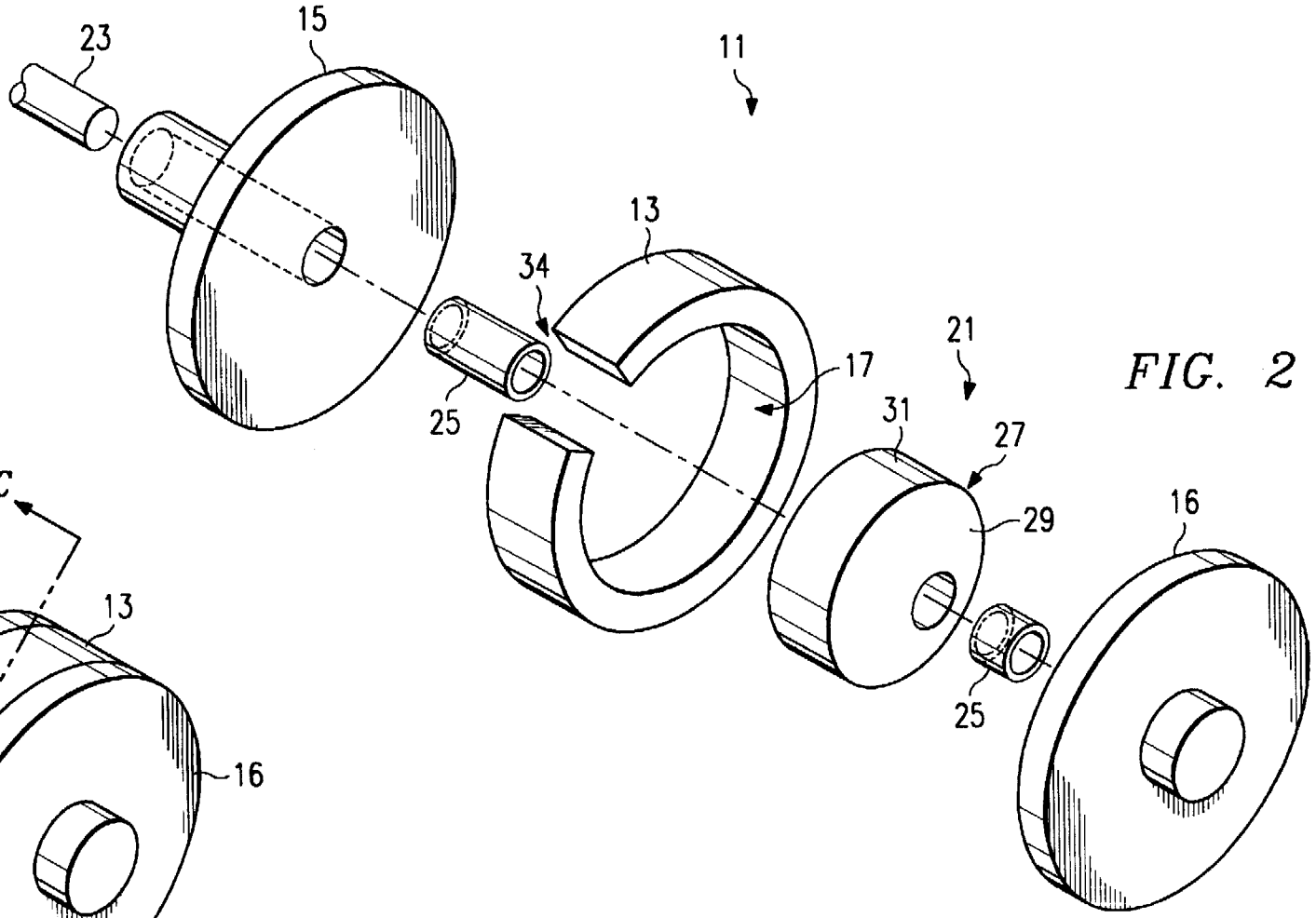
FIG. 2 is an exploded perspective view of the embodiment of a rotary compressor of FIG. 1.
Figure 1:
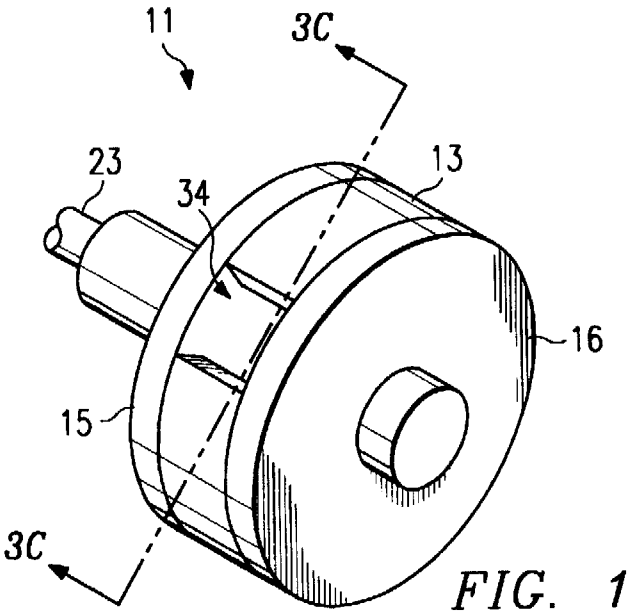
FIG. 1 is a perspective view of an embodiment of a rotary compressor according to the present invention, which compressor is missing a combination intake and exhaust manifold.

The present invention comprises an improved rotary compressor, including a housing having two ends and a bore extending therethrough; a rotor including a compression eccentric, which eccentric is housed within the bore of said housing and includes an axial shaft; a removable combination intake and exhaust manifold aligned with said compression eccentric and operable to convey fluid into and out of a compression space formed between said housing, said compression eccentric, and a removable combination dynamic seal and fluid channeling assembly, which assembly is securable between the manifold and the housing; and said combination dynamic seal and fluid channeling assembly further including means for retaining a sealing contact between the dynamic seal of said assembly and the compression eccentric when said assembly is in operable position, such that a compression stroke occurs in said compression space when the rotor is rotated. Various embodiments of the invention are illustrated in the appended drawings and described in greater detail, below. (All like numerical designations in the figures represent the same element.)

FIGS. 1 through 4F illustrate an embodiment of a rotary compressor 11 according to the present invention. Included in the compressor 11 is a housing 13 having two ends 15 and 16, and a bore 17 extending between said ends. Within the bore 17 is housed a rotor, which includes a compression eccentric 21 affixed to an axial shaft 23 via means which are known. A plurality of sealed bearings 25, such as those which are known, is further provided for rotatably securing the axial shaft 23 to each housing end 15 and 16; however, those skilled in the art will recognize that the axial shaft 23 may be similarly secured to each housing end 15 and 16 by closely controlling the manufactured tolerances between the exterior surface of the shaft 23 and where said shaft fits into each end 15 and 16. Annular seals (not shown) may also be provided between the housing 13 and the housing ends 15 and 16, for sealing the pressure across the rotor between the housing ends 15 and 16.

The compression eccentric 21 includes a substantially cylindrical rotor disk 27, having a pair of planar and parallel ends 29 and a peripheral wall 31. The compressor 11 further includes a removable combination intake and exhaust manifold 33 secured to the housing 13 via bolt means (not shown) such as those which are known, for conveying fluid into and out of the housing 13. In operable position, the manifold 33 is aligned with a seal-retaining channel 34, which channel 34 extends radially through the housing 13 and into the bore 17, for allowing communication between the manifold 33 and a compression space 35 formed between the housing 13, the compression eccentric 21, and a combination dynamic seal and fluid channeling assembly 37. The assembly 37 is securable in the seal-retaining channel 34 between the manifold 33 and the compression eccentric 21. The width of the rotor disk 27 is slightly less than the corresponding width of the bore 17, for allowing eccentric movement of the rotor disk 27 about the axial shaft 23 such that the peripheral wall 31 remains in constant tangential contact with a surface of the bore 17, without an attendant loss of pressure from the compression space 35.

The combination dynamic seal and fluid channeling assembly 37 includes means for retaining a dynamic seal 39 in continuous sealing contact with the compression eccentric 21, and further directs fluid into and out of the compression space 35. The assembly 37 further includes a seal housing 41 with which the dynamic seal 39 is slidably engaged, such that said dynamic seal 39 may move back and forth between the manifold 33 and the compression eccentric 21 attendant to the eccentric movement of the rotor disk 27 about the axial shaft 23. The assembly 37 also includes means for retaining a sealing contact between the dynamic seal 39 and the compression eccentric 21 when said assembly 37 is in operable position, such that a compression stroke occurs in the compression space 35 when the rotor is rotated. Such sealing-contact retaining means of the compressor 11 is a spring 43 positioned within the seal housing 41 and between the manifold 33 and the dynamic seal 39. Those skilled in the art will recognize, however, that said means for retaining sealing contact between the dynamic seal 39 and the corresponding compression eccentric 21 may comprise components other than said spring 43, such as those which use hydraulic, pneumatic or electrical forces for pressing the dynamic seal 39 against the rotor disk 27.

The combination intake and exhaust manifold 33 further includes an intake port 45 and an exhaust port 47. Both of said ports 45 and 47 are in communication with a fluid channeling chamber 49 disposed within the manifold 33. The seal housing 41 of the assembly 37 is securable in the channeling chamber 49 via bolt means 51, for allowing the assembly 37 to be removable from the housing 13 simultaneously with the manifold 33. However, those skilled in the art will recognize that it may be just as desirable that the seal housing 41 be formed as an integral part of the manifold 33, via means which are known. The seal housing 41 is positioned such that the seal engaging channel 34 of the housing 13 is divided by the dynamic seal 39 into an intake portion 34N and an exhaust portion 34X. It is preferred that said intake portion 34N is larger than said exhaust portion 34X. A reed valve (not shown) may be connected to the exhaust port 47, or may be otherwise emplaced in the manifold 33 as part of the fluid channeling chamber 49, as part of the exhaust port 47, or between the fluid channeling chamber 49 and the exhaust port 47, for controlling the direction of fluid through the compressor 11.

It is also preferred that each surface of the various components of the compressor 11 which is in frictionable contact with at least another surface, is coated with a thermally resistant solid coating, for reducing the friction between such surfaces and, thereby, reducing the wear and tear on such components, which wear and tear is due to friction. Furthermore, it is preferred that said thermally resistant solid coating be readily replaceable, for minimizing any down-time attendant to maintenance efforts regarding such surfaces, which efforts concern wear and tear due to friction. An example of such thermally resistant solid coatings is that comprising self-lubricating carbon alloys #122, 551, 581 and 3383 by the ROC Carbon Company of Houston, Tex.; although those skilled in the art will recognize that a wide variety of other such thermally resistant coatings exist which may be just as useful in this regard. Compressor surfaces on which it is desirable to have such coating include surfaces of the compression eccentric 21 which are in contact with the housing 13, surfaces of the housing 13 which are in contact with the compression eccentric 21, surfaces of the axial shaft 23 which are in contact with the housing 13, surfaces of the housing 13 which are in contact with the axial shaft 23, surfaces of the dynamic seal 39 which are in contact with the compression eccentric 21 or the seal housing 41, and surfaces of the seal housing 41 which are in contact with the dynamic seal 39.

In operation, fluid is introduced into the compressor 11 through the intake port 45 of the manifold 33. Said fluid is transferred from the intake port 45 past the combination dynamic seal and fluid channeling assembly 37, through the intake portion 34N of the seal-engaging channel 34 and into the compression space 35, where the fluid is compressed via rotation of the compression eccentric 21 about the axial shaft 23. Such rotation of the axial shaft 23 is accomplished via means which are known. Compressed fluid exits the compression space 35 through the exhaust portion 34X of the seal-engaging channel 34 and is directed toward the exhaust port 47 of the manifold 33 via the combination dynamic seal and fluid channeling assembly 37.

Figure 3C:
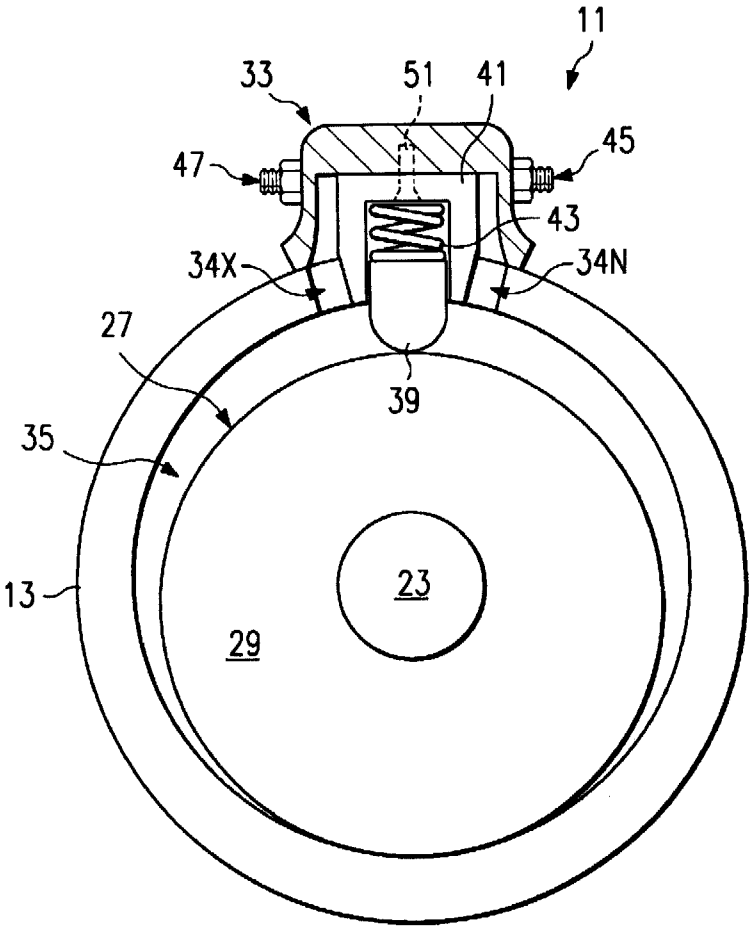
FIG. 3C is a section view of the embodiment of a rotary compressor of FIG. 1 along line 3C—3C of FIG. 1.
Figure 3B:
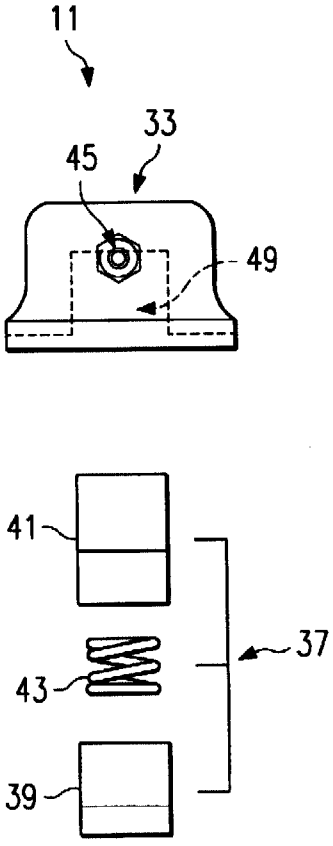
FIG. 3B is an exploded side view of the removable combination intake and exhaust manifold and combination dynamic seal and fluid channeling assembly of the embodiment of a rotary compressor of FIG. 3A.
Figure 3A:
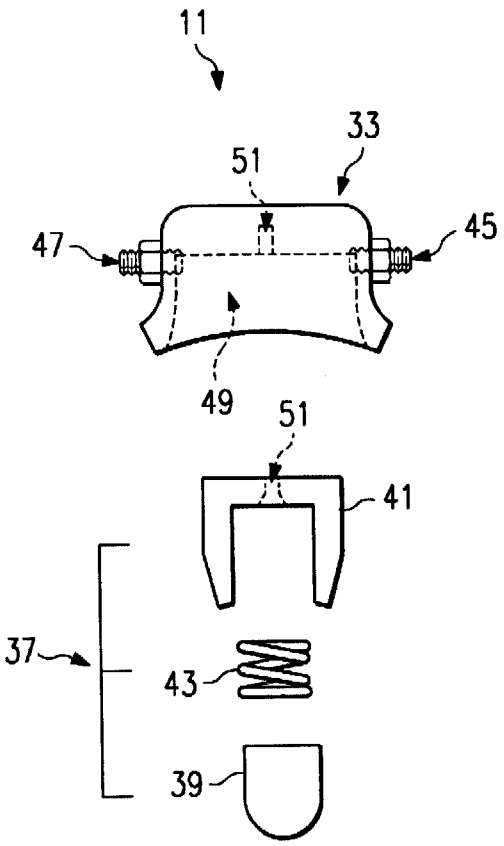
FIG. 3A is an exploded frontal view of a removable combination intake and exhaust manifold and a combination dynamic seal and fluid channeling assembly of the embodiment of a rotary compressor of FIGS. 1 and 2.
Figure 4A:
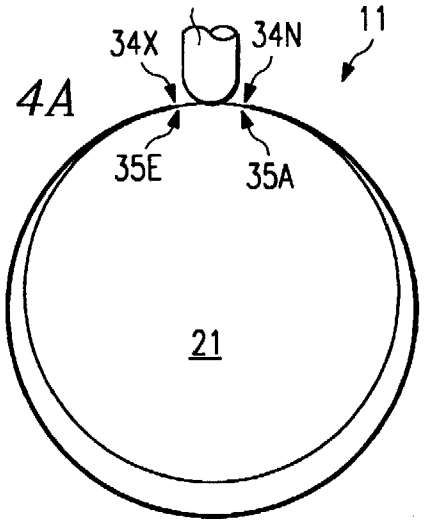
FIGS. 4A–4F are partial section views similar to that of FIG. 3C of the embodiment of a rotary compressor of FIG. 1, illustrating the intake, compression and exhaust cycles of said embodiment.
Figure 4B:
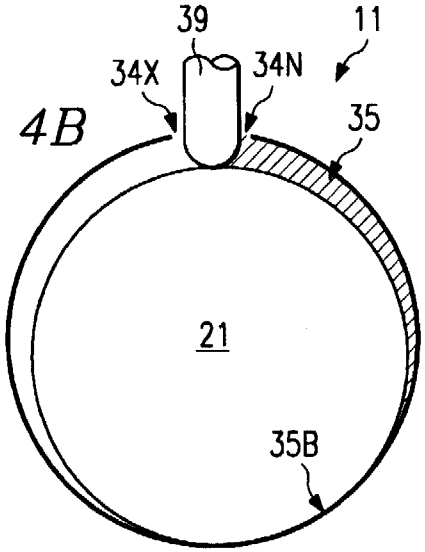
Figure 4C:
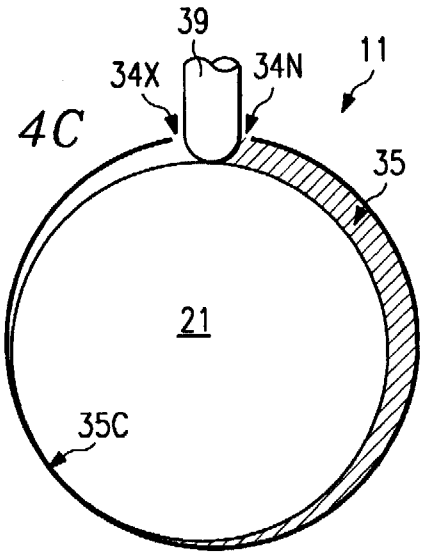
Figure 4D:
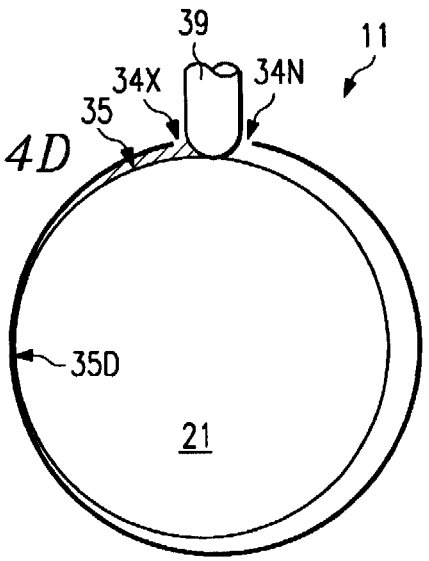
Figure 4E:
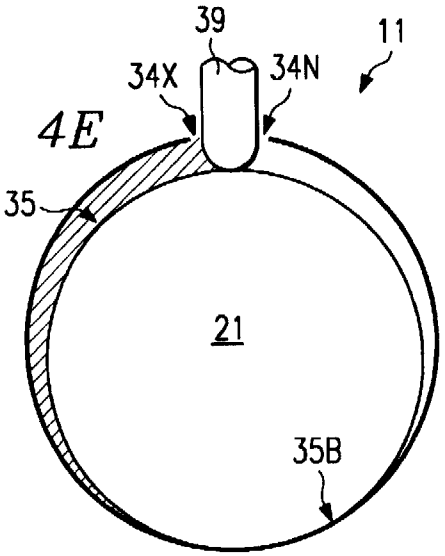
Figure 4F:
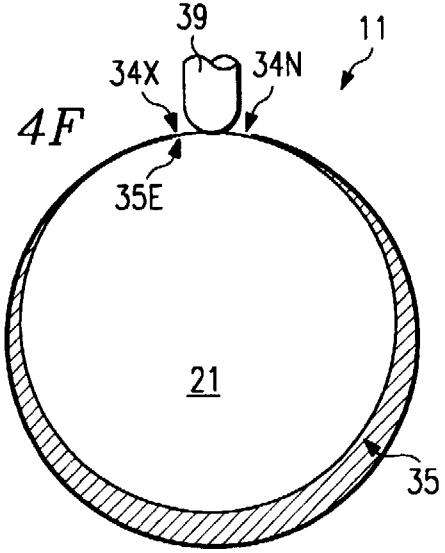
Figures 5A, 5B, 5C, 5D:
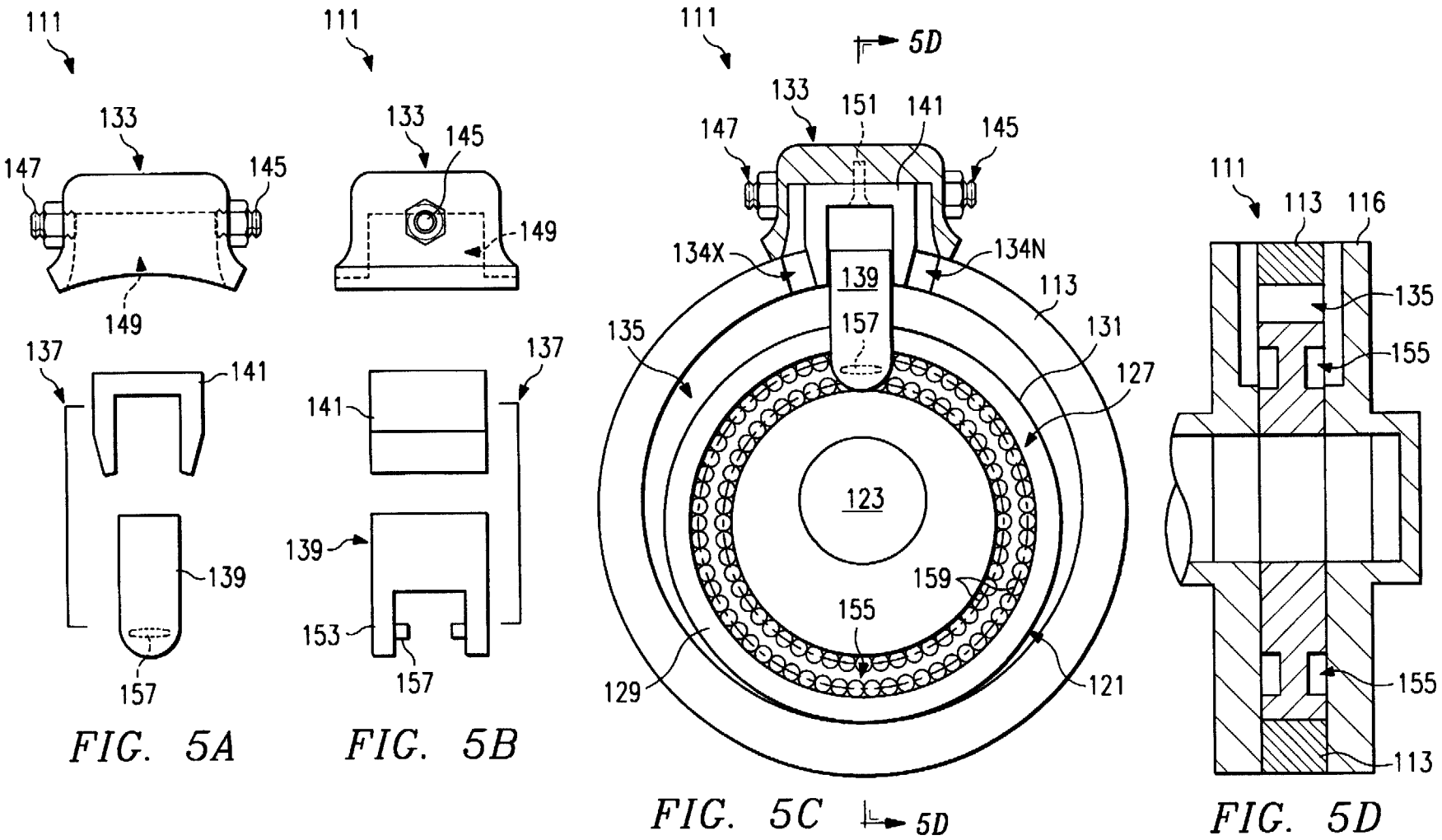
FIG. 5A is an exploded frontal view of a removable combination intake and exhaust manifold and a combination dynamic seal and fluid channeling assembly of another embodiment of a rotary compressor according to the present invention.
FIG. 5B is an exploded side view of the removable combination intake and exhaust manifold and combination dynamic seal and fluid channeling assembly of the embodiment of a rotary compressor of FIG. 5A.
FIG. 5C is a section view of the embodiment of a rotary compressor of FIG. 5A similar to the section view of FIG. 3C.
FIG. 5D is a section view of the embodiment of a rotary compressor of FIG. 5C along line 5D—5D of FIG. 5C.

FIGS. 4A through 4F are partial section views similar to that of FIG. 3C, illustrating the operation of the compression eccentric 21 and the fluid intake, compression and exhaust cycles of compressor 11. As the eccentric 21 rotates (clockwise in the illustrations) from a tangential point 35A over the intake portion 34N of the seal engaging channel 34, and past subsequent tangential points 35B, 35C, and 35D, the volume of the compression space 35 increases and the pressure inside said space 35 decreases. When the eccentric 21 rotates to a tangential point 35E, over the exhaust portion 34X of the seal engaging channel 34, the compression space 35 reaches its largest volume and its lowest pressure. At this point, the intake cycle of the operation is complete. From this point, the compression eccentric 21 continues to rotate past the starting point 35A, and subsequent points 35B, 35C and 35D, as the operation goes through the compression cycle, during which cycle the volume of the compression space 35 decreases, resulting in the fluid therein being compressed and the pressure inside said space 35 being increased. As the fluid pressure inside the compression space 35 continues to increase, fluid is channeled out of the space 35 and through the exhaust portion 34X of the seal engaging channel 34, beginning the exhaust cycle of the operation. The exhaust cycle continues until the eccentric 21 rotates for the second time to the tangential point 35E over the exhaust portion 34X of the seal engaging channel 34, at which point the volume of the compression space 35 is reduced to zero.

In FIGS. 5A through 5D is illustrated another embodiment of a rotary compressor 111, which is substantially similar to the compressor 11, except in regard to the dynamic seal and means for retaining sealing contact between such seal and the corresponding compression eccentric. The compressor 111 includes a rotor housed within a housing bore 117, which rotor comprises a compression eccentric 121 affixed to an axial shaft 123 via means which are known. A plurality of sealed bearings (not shown) is further provided for rotatably securing the axial shaft 123 to each of a pair of housing ends 115 and 116. However, those skilled in the art will recognize that the axial shaft 123 may be similarly secured to each housing end 115 and 116 by closely controlling the manufactured tolerances between the exterior surface of the shaft 123 and where said shaft fits into each end 115 and 116. Annular seals (not shown) may also be provided between the housing 113 and the housing ends 115 and 116, for sealing the pressure across the rotor between the housing ends 115 and 116.

The compression eccentric 121 includes a substantially cylindrical rotor disk 127, having a pair of planar and parallel ends 129 and a peripheral wall 131. The diameter of each end 129 is smaller than the diameter of the housing bore 117. The compressor 111 further includes a removable combination intake and exhaust manifold 133 securable to the housing 113 via means which are known, for conveying fluid into and out of the housing 113. In operable position, the manifold 133 is aligned with a seal-retaining channel 134, which channel 134 extends radially through the housing 113 and into the bore 117, for allowing communication between the manifold 133 and a compression space 135 formed between the housing 113, the compression eccentric 121, and a combination dynamic seal and fluid channeling assembly 137. Said assembly 137 is securable in the seal-retaining channel 134 between the manifold 133 and the compression eccentric 121. The width of the rotor disk 127 is slightly less than the corresponding width of the bore 117, for allowing eccentric movement of the rotor disk 127 about the axial shaft 123 such that the peripheral wall 131 remains in constant tangential contact with a surface of the bore 117 without an attendant loss of pressure from the compression space 135.

The combination dynamic seal and fluid channeling assembly 137 includes means for retaining a dynamic seal 139 in continuous sealing contact with the compression eccentric 121, and further directs fluid into and out of the compression space 135. The assembly 137 also includes a seal housing 141 with which the dynamic seal 139 is slidably engaged, such that said dynamic seal 139 may move back and forth between the manifold 133 and the compression eccentric 121 attendant to the eccentric movement of the rotor disk 127 about the axial shaft 123. Said means for retaining a sealing contact between the dynamic seal 139 and the compression eccentric 121 when the assembly 137 is in operable position, comprises a pair of eccentric-retaining arms 153 extending from the dynamic seal 139 and along a portion of each planer end 129 of the rotor disk 127 toward the axial shaft 123. Each of said eccentric-retaining arms 153 includes means for engaging an annular seal-retaining channel 155 formed in each of the planar ends 129 of the rotor disk 127. Said channel 155 engaging means is a channel-guide wing 157 formed on each retaining arm 153. Each of the seal-retaining channels 155 is concentric with the rotor disk peripheral wall 131, and includes a pair of annular bearings 159, between which the corresponding guide wing 157 glides when the rotor disk 127 is rotated. Those skilled in the art will recognize that a single annular bearing connected directly to each retaining arm 153, for gliding through the corresponding channel 155 may be utilized in lieu of each combination wing 157 and pair of annular bearings 159. Also, those skilled in the art will recognize that said means for retaining sealing contact between the dynamic seal 139 and the corresponding compression eccentric 121 may comprise components other than said pair of eccentric-retaining arms 153 working in conjunction with a corresponding seal-retaining channels 155, such as those means which use spring, hydraulic, pneumatic or electrical forces for pressing a dynamic seal against a compression eccentric. However, the use of retaining arms 153 in conjunction with annular bearings and seal-retaining channels 155 provide for a sealing efficiency about the compression space 35 which is superior to that which is attainable through the use of such pressing forces, especially when the corresponding rotor is turning at high speeds.

The combination intake and exhaust manifold 133 further includes an intake port 145 and an exhaust port 147. Both of said ports 145 and 147 are in communication with a fluid channeling chamber 149 disposed within the manifold 133. The seal housing 141 of the assembly 137 is secured in said channeling chamber 149 via bolt means 151, for allowing the seal housing 139 to be removable from the housing 113 simultaneously with the manifold 133. However, those skilled in the art will recognize that it may be just as desirable that the seal housing 141 be formed as an integral part of the manifold 133, via means which are known. The seal housing 141 is positioned such that the seal engaging channel 134 is divided by the dynamic seal 139 into an intake portion 134N and an exhaust portion 134X. It is preferred that said intake portion 134N is larger than said exhaust portion 134X. A reed valve (not shown) may be connected to the exhaust port 147, or may be otherwise emplaced in the manifold 133 as part of the fluid channeling chamber 149, as part of the exhaust port 147, or between the fluid channeling chamber 149 and the exhaust port 147, for controlling the direction of fluid through the compressor 111.

It is also preferred that each surface of the various components of the compressor 111 which is in frictionable contact with at least another surface, is coated with a thermally resistant solid coating, for reducing the friction between such surfaces and, thereby, reducing the wear and tear on such components, which wear and tear is due to friction. Furthermore, it is preferred that said thermally resistant solid coating be readily replaceable, for minimizing any down-time attendant to maintenance efforts regarding such surfaces, which efforts concern wear and tear due to friction. Like the compressor 11, such surfaces of the compressor 111 on which it is desirable to have such coating include surfaces of the compression eccentric 121 which are in contact with the housing 113, surfaces of the housing 113 which are in contact with the compression eccentric 121, surfaces of the axial shaft 123 which are in contact with the housing 113, surfaces of the housing 113 which are in contact with the axial shaft 123, surfaces of the dynamic seal 139 which are in contact with the compression eccentric 121 or the seal housing 141, and surfaces of the seal housing 141 which are in contact with the dynamic seal 139.

In operation, fluid is introduced into the compressor 111 through the intake port 145 of the manifold 133. Said fluid is transferred from the intake port 145, through a portion of the fluid channeling chamber 149 past the combination dynamic seal and fluid channeling assembly 137, through the intake portion 134N of the seal-engaging channel 134 and into the compression space 135, where the fluid is compressed via rotation of the compression eccentric 121 about the axial shaft 123. Such rotation of the axial shaft 123 is accomplished via means which are known. Compressed fluid exits the compression space 135 through the exhaust portion 134X of the seal-engaging channel 134 and is directed through a portion of the fluid channeling chamber 149 toward the exhaust port 147 via the combination dynamic seal and fluid channeling assembly 137. The fluid intake, compression and exhaust cycles of this embodiment are substantially similar to those described in conjunction with compressor 11 and illustrated in FIGS. 4A–4F.

Figure 6:
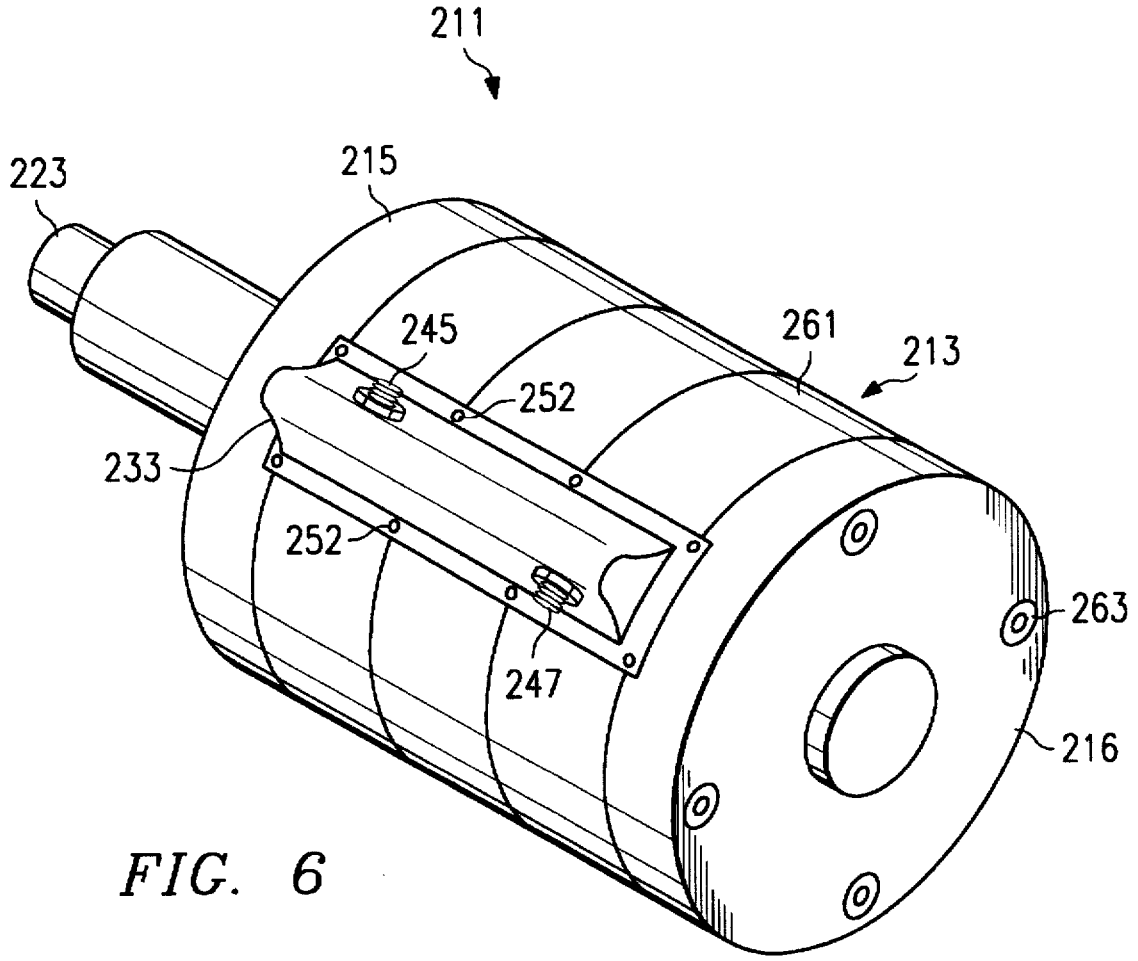
FIG. 6 is a perspective view of another embodiment of a rotary compressor according to the present invention.
Figure 7:
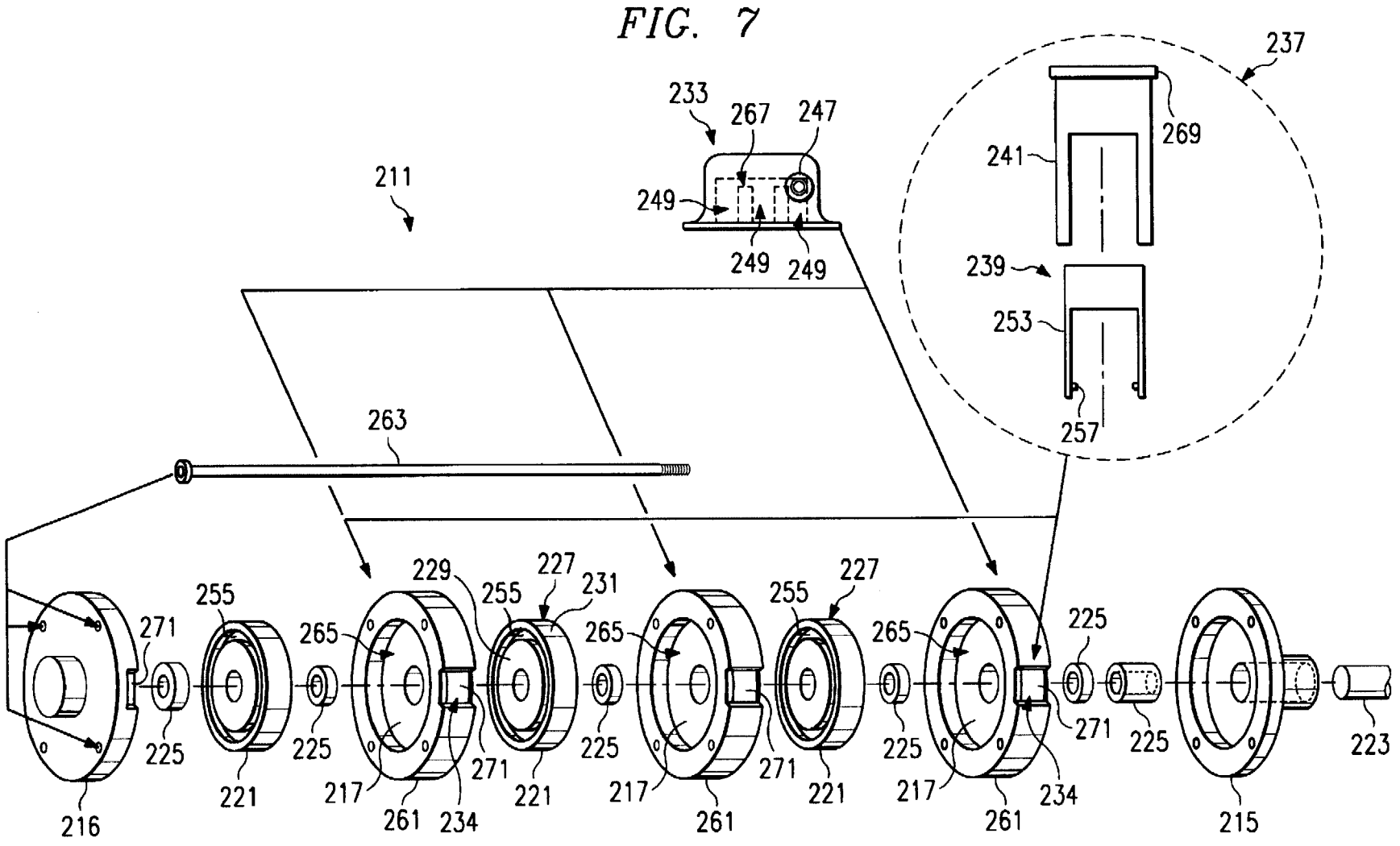
FIG. 7 is an exploded perspective view of the embodiment of a rotary compressor of FIG. 6.

FIGS. 6 and 7 illustrate another embodiment of a rotary compressor 211, which is substantially similar to the compressor 111, but further includes a plurality of rotor disks 227 housed within a corresponding plurality of disk housing units 261. Each disk housing unit 261 is substantially cylindrical and comprises a first end, a second end, a peripheral wall and a bore 217 extending between said first and second ends. The housing units 261 combine coaxially with a pair of housing ends 215 and 216 to form a compressor housing 213 (FIG. 6), and are held together with said housing ends 215 and 216 via a plurality of elongate bolt means 263. The compressor 211 further includes a rotor, which comprises a plurality of compression eccentrics 221 affixed to an axial shaft 223 via means which are known. Each of the compression eccentrics 221 includes a substantially cylindrical rotor disk 227, having a pair of planar and parallel ends 229 and a peripheral wall 231. Each rotor disk 227 is positioned about the axial shaft 223 in such manner that the corresponding compression eccentric 221 is out of phase with the other compression eccentrics 221 of the compressor 211. Each compression eccentric 221 is further spaced about the axial shaft 223 relative to the other compression eccentrics 221 in an annular array, wherein there is an equivalent angle between the diameter of each eccentric 221 which diameter is perpendicular to the axial shaft 223, for creating a balance between the eccentrics 221 as they rotate about the axial shaft 223.

The diameter of each end 229 is smaller than the diameter of the corresponding housing bore 217. Each disk 227 is divided by a compression retaining wall 265, which wall is affixed to an end of a corresponding disk housing unit 261. Said retaining wall 265 may be formed as part of the corresponding disk housing unit 261, or otherwise be connected thereto via means which are known. A plurality of sealed bearings 225 is further provided for rotatably securing the axial shaft 223 to each housing end 215 and 216, and to each compression retaining wall 265. Those skilled in the art will recognize, however, that the axial shaft 223 may be similarly secured to each housing end 215 and 216, and to each compression retaining wall 265, by closely controlling the manufactured tolerances between the exterior surface of the shaft 223 and where said shaft fits into each end 215 and 216 and compression retaining wall 265. Annular seals (not shown) may also be provided between each disk housing unit 261 and the corresponding compression retaining wall (s) 265 or housing end 215 or 216, for sealing the pressure across the rotor.

The compressor 211 further includes a removable combination intake and exhaust manifold 233 secured to the housing 213 via bolt means 252, for conveying fluid into and out of the disk housing units 261. In operable position, the manifold 233 is aligned with a plurality of seal-engaging channels 234 of the disk housing units 261, each of which channels 234 extends radially through the corresponding housing unit 261 into the corresponding bore 217. The seal-engaging channels 234 are provided for allowing communication between the manifold 233 and a plurality of compression spaces analogous to compression spaces 35 and 135 formed within the compressor housing 213. Each of said compression spaces is formed between a corresponding disk housing unit 261, a corresponding compression eccentric 221, a corresponding combination dynamic seal and fluid channeling assembly 237, and corresponding compression retaining wall(s) 265 or housing end 215 or 216. The width of each rotor disk 227 is slightly less than the width of the corresponding bore 217, for allowing eccentric movement of said rotor disk 227 about the axial shaft 223 such that the peripheral wall 231 of said disk 227 remains in constant tangential contact with a surface of the bore 217, without an attendant loss of pressure from the corresponding compression space.

Each combination dynamic seal and fluid channeling assembly 237 is securable in the corresponding seal-engaging channel 234 between a corresponding fluid channeling chamber 249 disposed within the manifold 233, and a corresponding compression eccentric 221. Each fluid channeling chamber 249 is in communication with other fluid channeling chambers 249, an intake port (not shown) and an exhaust port 247 of the manifold 233 via a corresponding intake channel (not shown) or exhaust channel 267. A reed valve (not shown) may be affixed to the exhaust port 247, emplaced between the exhaust channel 267 and the exhaust port 247, or emplaced between each fluid channeling chamber 249 and the exhaust channel 267, for controlling the direction of fluid through the compressor 211. Each assembly 237 further includes means for retaining a dynamic seal 239 in continuous sealing contact with a corresponding compression eccentric 221, and further directs fluid into and out of the corresponding compression space 235. Each assembly 237 also includes a seal housing 241 with which the dynamic seal 239 is slidably engaged, such that said dynamic seal 239 may move back and forth between the manifold 233 and the corresponding compression eccentric 221 attendant to the eccentric movement of thee corresponding rotor disk 227 about the axial shaft 223. Each seal housing 261 is positioned such that the corresponding seal engaging channel 234 is divided by the corresponding dynamic seal 239 into an intake portion and an exhaust portion. It is preferred that said intake portion is larger than said exhaust portion.

Said means for retaining a sealing contact between each dynamic seal 239 and the corresponding compression eccentric 221 when the assembly 237 is in operable position, comprises a pair of eccentric-retaining arms 253 extending from each dynamic seal 239 and along a portion of each planer end 229 of the corresponding rotor disk 227 toward the axial shaft 223. Each of said eccentric-retaining arms 253 includes means for engaging a corresponding seal-retaining channel 255 formed in each of the planar ends 229, which engaging means is substantially similar to that of the compressor 111. Those skilled in the art will recognize, however, that said means for retaining sealing contact between the dynamic seal 239 and the corresponding compression eccentric 221 may comprise components other than said pair of eccentric-retaining arms 253 working in conjunction with said corresponding seal-retaining channels 255, such as those means which use spring, hydraulic, pneumatic or electrical forces for pressing a dynamic seal against a compression eccentric.

Unlike the seal housing 141 of the compressor 111, the seal housing 241 is not secured to the channeling chamber 249 for allowing the assembly 237 to be removable from the housing 213 simultaneously with the manifold 233. Rather, each seal housing 241 includes a pair of shoulders 269 extending from the fluid channel end of the corresponding seal housing 241, for interlocking with a corresponding pair of shoulder rests 271 provided on each disk housing unit 261 adjacent to the seal-engaging channel 234.

It is preferred that each surface of the various components of the compressor 211 which is in frictionable contact with at least another surface, is coated with a thermally resistant solid coating, for reducing the friction between such surfaces and, thereby, reducing the wear and tear on such components, which wear and tear is due to friction. Furthermore, it is preferred that said thermally resistant solid coating be readily replaceable, for minimizing any downtime attendant to maintenance efforts regarding such surfaces, which efforts concern wear and tear due to friction. Like the compressors 11 and 111, such surfaces of the compressor 211 on which it is desirable to have such thermally resistant coating include surfaces of the compression eccentric 221 which are in contact with the housing 213, surfaces of the housing 213 which are in contact with the compression eccentric 221, surfaces of the axial shaft 223 which are in contact with the housing 213 or compression retaining walls 265, surfaces of the housing 213 or compression retaining walls 265 which are in contact with the axial shaft 223, surfaces of the dynamic seal 239 which are in contact with the compression eccentric 221 or the seal housing 241, and surfaces of the seal housing 241 which are in contact with the dynamic seal 239.

In operation, fluid is introduced into the compressor 211 through the intake pod 245 of the manifold 233. Said fluid is transferred from the intake port 245 through the intake channel (not shown) and into each fluid channeling chamber 249, where the fluid is channeled past the combination dynamic seal and fluid channeling assembly 237 corresponding to said chamber 249, through the intake portion of the corresponding seal-engaging channel 234 and into the corresponding compression space, where the fluid is compressed via rotation of the corresponding compression eccentric 221 about the axial shaft 223. Such rotation of the axial shaft 223 is accomplished via means which are known. Compressed fluid exits each compression space through the exhaust portion of the corresponding seal-engaging channel 234, and is directed via the combination dynamic seal and fluid channeling assembly 237 into and through the corresponding fluid channeling chamber 249. Said compressed fluid then travels through the exhaust channel 267 where said compressed fluid is combined with compressed fluid from the other compression chambers 235 and channeled toward the exhaust port 247. The fluid intake, compression and exhaust cycles of the compressor 211 are substantially similar to those described in conjunction with compressor 11 and illustrated in FIGS. 4A–4F.

In summary, the present invention comprises a rotary compressor having a unique simplicity of design which provides a significant reduction in costs associated with the manufacture and maintenance of rotary compressors. Said simplicity is due to the unique use of a combination dynamic seal and fluid channeling assembly in conjunction with a removable combination intake and exhaust manifold. Also provided is unique means for retaining the dynamic seal of a rotary compressor in continuous contact with a compression eccentric, for providing better compression efficiencies than have been previously known with rotary compressors. Still further provided is the use of thermally resistant solid coatings on various compressor surfaces, for providing less thermal distortion of such surfaces, and less costly means for lubricating and otherwise maintaining such surfaces.

The inventor has given a non-limiting description of several embodiments of the present invention, to which many changes may be made without deviating from the spirit of the inherent inventive concept. While this invention has been described with reference to such illustrative embodiments, this description is not intended to be construed in a limiting sense. Various modifications and combinations of the various embodiments as well as other embodiments of this invention will be apparent to a person skilled in the art upon reference to this description. It is therefore contemplated that the appended claims cover any such modifications and/or embodiments that fall within the true scope of the present invention.

It is claimed:

1. A rotary compressor, comprising:

a housing having two ends and a bore extending therethrough;

at least one rotor including a compression eccentric, the at least one rotor disposed within the bore and including an axial shaft, the compression eccentric having two planar ends, each of the planar ends having an annular seal-retaining channel formed therein, the annular seal-retaining channel defined by first and second annular walls, each of the seal-retaining channels having an annular bearing disposed therein, the annular bearing comprising a collar having a first surface facing the first annular wall and a second surface facing the second annular wall;

a removable combination intake and exhaust manifold aligned with the compression eccentric and operable to convey fluid into and out of a compression space formed between the housing and compression eccentric;

a combination dynamic seal and fluid channeling assembly comprising a dynamic seal, the combination dynamic seal and fluid channeling assembly securable between the manifold and the housing; and wherein the combination dynamic seal and fluid channeling assembly comprises a pair of eccentric-retaining arms extending from the dynamic seal, each of the eccentric-retaining arms including two channel guide wings engaging the annular bearing disposed within the seal-retaining channel formed in each of the ends of the rotor disk, the first and second surfaces of the collar of the annular bearing maintaining the guide wings of the eccentric retaining arms in spaced relation from one of the first and second annular walls.

2. The rotary compressor of claim 1 wherein:

the at least one rotor including a compression eccentric comprises a plurality of rotors housed within the bore, each rotor including a compression eccentric, each compression eccentric having two planar ends, each of the planar ends having an annular seal-retaining channel formed therein, each of the seal-retaining channels having an annular bearing disposed therein;

the removable combination intake and exhaust manifold is further aligned with the plurality of compression eccentrics and operable to convey fluid into and out of a plurality of compression spaces, each of said compression spaces being formed between said housing, one of said plurality of compression eccentrics, and a corresponding combination dynamic seal and fluid channeling assembly securable between the manifold and the housing; and each combination dynamic seal and fluid channeling assembly including a pair of eccentric-retaining arms extending from the dynamic seal, each of the eccentric-retaining arms including two channel guide wings engaging the annular bearing disposed within the seal-retaining channel formed in each of the ends of the rotor disk.

3. The rotary compressor of claim 1 wherein each annular bearing comprises a bearing concentric with the compression eccentric.

4. The rotary compressor of claim 1 wherein each annular bearing comprises ball bearings.

5. The rotary compressor of claim 3 wherein each annular bearing comprises ball bearings.

6. The rotary compressor of claim 1 wherein the at least one rotor comprises a circular rotor.

7. The rotary compressor of claim 1 wherein the at least one rotor including a compression eccentric comprises a circular compression eccentric.

8. A rotary compressor, comprising:

a housing having two ends and a bore extending therethrough;

a rotor including a compression eccentric, the rotor disposed within the bore and including an axial shaft, the compression eccentric having two planar ends, each of the planar ends having an annular seal-retaining channel formed therein, the annular seal-retaining channel defined by first and second annular walls, each of the seal-retaining channels having a pair of annular bearings disposed therein, each annular bearing comprising a collar having a first surface facing the first annular wall and a second surface facing the second annular wall;

a removable combination intake and exhaust manifold aligned with the compression eccentric and operable to convey fluid into and out of a compression space formed between the housing and compression eccentric;

a dynamic seal and fluid channeling assembly comprising a dynamic seal, the dynamic seal and fluid channeling assembly securable between the manifold and the housing; and wherein the combination dynamic seal and fluid channeling assembly comprises a pair of eccentric-retaining arms each of the eccentric-retaining arms including two channel guide wings engaging the pair of annular bearings disposed within the seal-retaining channel formed in each of the ends of the rotor disk, the first and second surfaces of each collar of the pair of annular bearings maintaining the guide wings of the eccentric retaining arms in spaced relation from the first and second annular walls, the dynamic seal operable to move between the compression eccentric and the combination intake and exhaust manifold.

9. The rotary compressor of claim 8 wherein each pair of annular bearings comprises concentric annular bearings.

10. The rotary compressor of claim 8 wherein each pair of annular bearings comprises ball bearings.

11. The rotary compressor of claim 9 wherein each pair of annular bearings comprises bah bearings.

12. The rotary compressor of claim 8 wherein the rotor is circular.

13. The rotary compressor of claim 8 wherein the compression eccentric is circular.

14. The rotary compressor of claim 13 wherein each of the annular scal-retaining channels is concentric with the compression eccentric.

* * * * *